US008734179B2

(12) United States Patent
Tsai et al.

(10) Patent No.: US 8,734,179 B2
(45) Date of Patent: May 27, 2014

(54) CABLE CONNECTOR AND MANUFACTURING METHOD THEREOF

(71) Applicant: Lotes Co., Ltd., Keelung (TW)

(72) Inventors: Shang Ju Tsai, Keelung (TW); Yan Xian Yuan, Guangzhou (CN); Yao Li, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 58 days.

(21) Appl. No.: 13/710,005

(22) Filed: Dec. 10, 2012

(65) Prior Publication Data

US 2014/0038464 A1 Feb. 6, 2014

(30) Foreign Application Priority Data

Aug. 1, 2012 (CN) ..... 2012 1 0270648

(51) Int. Cl.
*H01R 11/24* (2006.01)

(52) U.S. Cl.
USPC ..... 439/394; 439/582; 29/866; 29/857

(58) Field of Classification Search
CPC ..... H01R 9/053
USPC ..... 439/581, 582, 395, 399, 407, 400, 401; 29/828, 857, 866
See application file for complete search history.

(56) References Cited

U.S. PATENT DOCUMENTS 4,708,414 A * 11/1987 Lam ..... 439/394
5,772,470 A * 6/1998 Togashi ..... 439/582
6,508,668 B1 * 1/2003 Yamane ..... 439/582
6,572,407 B1 * 6/2003 Ko ..... 439/582
6,712,645 B1 * 3/2004 Chou ..... 439/582
6,739,907 B2 * 5/2004 Kuroda et al. ..... 439/582
6,746,268 B2 * 6/2004 Laub et al. ..... 439/394
6,878,011 B2 * 4/2005 Laub et al. ..... 439/585
6,945,819 B2 * 9/2005 Laub et al. ..... 439/585
6,960,097 B2 * 11/2005 Morishita ..... 439/404
6,997,745 B2 * 2/2006 Ikeda ..... 439/582
7,008,256 B2 * 3/2006 Poiraud ..... 439/394
7,025,598 B2 * 4/2006 Ikeda ..... 439/63
7,204,715 B2 * 4/2007 Kukita ..... 439/582
7,351,067 B2 * 4/2008 Chen et al. ..... 439/63
7,367,840 B2 * 5/2008 Chen et al. ..... 439/581
7,465,191 B1 * 12/2008 Ho ..... 439/582
7,467,973 B2 * 12/2008 Lee et al. ..... 439/582
7,704,096 B2 * 4/2010 Liao et al. ..... 439/582
7,753,690 B2 * 7/2010 Maruyama et al. ..... 439/63
7,833,054 B2 * 11/2010 Matsumoto ..... 439/582
7,938,681 B2 * 5/2011 Lee et al. ..... 439/582

(Continued)

*Primary Examiner* — Ross Gushi
(74) *Attorney, Agent, or Firm* — Morris Manning & Martin LLP; Tim Tingkang Xia, Esq.

(57) ABSTRACT

A cable connector and a manufacturing method thereof. The method includes: providing an insulation body, putting a terminal that has a receiving portion into the insulation body, preparing at least one groove on a cable, in which the cable has a first part inserted in the insulation body and a second part extending out of the insulation body, and the groove is provided on the first part, pressing the cable, so that a side edge of the receiving portion pierces the cable at the groove, thereby electrically connecting the terminal and an inner conductor of the cable. The groove enables the terminal to pierce the cable easily, implementing desirable electrical connection between the inner conductor and the terminal, and also stops the cable in the extending direction of the cable, preventing the cable from escaping.

21 Claims, 6 Drawing Sheets

(56) References Cited

U.S. PATENT DOCUMENTS

| | | | | |
|---|---|---|---|---|
| 7,972,174 | B2 * | 7/2011 | Maruyama et al. | 439/582 |
| 8,047,871 | B2 * | 11/2011 | Kohnishi et al. | 439/582 |
| 8,137,134 | B1 * | 3/2012 | Chang | 439/582 |
| 8,172,613 | B1 * | 5/2012 | Chen et al. | 439/582 |
| 8,317,540 | B2 * | 11/2012 | Chen | 439/582 |
| 8,628,353 | B2 * | 1/2014 | Yokoyama | 439/582 |
| 2002/0155755 | A1 * | 10/2002 | Yamane | 439/582 |
| 2003/0104720 | A1 * | 6/2003 | Laub et al. | 439/394 |
| 2003/0181100 | A1 * | 9/2003 | Kuroda et al. | 439/582 |
| 2004/0166731 | A1 * | 8/2004 | Laub et al. | 439/578 |
| 2005/0042920 | A1 * | 2/2005 | Poiraud | 439/582 |
| 2005/0130485 | A1 * | 6/2005 | Morishita | 439/394 |
| 2008/0014792 | A1 * | 1/2008 | Chen et al. | 439/581 |
| 2010/0022122 | A1 * | 1/2010 | Matsumoto | 439/578 |
| 2010/0062639 | A1 * | 3/2010 | Kohnishi et al. | 439/582 |
| 2010/0062640 | A1 * | 3/2010 | Maruyama et al. | 439/582 |
| 2010/0062641 | A1 * | 3/2010 | Maruyama | 439/582 |
| 2011/0021073 | A1 * | 1/2011 | Matsumoto | 439/582 |
| 2012/0088403 | A1 * | 4/2012 | Yokoyama | 439/582 |
| 2012/0142211 | A1 * | 6/2012 | Kubo | 439/426 |
| 2012/0329319 | A1 * | 12/2012 | Zhao | 439/578 |

* cited by examiner

CABLE CONNECTOR AND MANUFACTURING METHOD THEREOF

CROSS-REFERENCE TO RELATED APPLICATION

This non-provisional application claims priority under 35 U.S.C. §119(a) on Patent Application No. 201210270648.1 filed in P.R. China on Aug. 1, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to a cable connector and a manufacturing method thereof, and in particular, to a cable connector capable of firmly connecting a cable and a terminal, and a manufacturing method thereof.

BACKGROUND OF THE INVENTION

A common radio frequency cable connector in the industry includes an insulation body. A receiving slot is provided in the insulation body. An insulation cover is disposed at a side of the receiving slot. A terminal is disposed in the insulation body. A shield shell wraps the insulation body. A coaxial cable is disposed in the receiving slot, and an inner conductor of the coaxial cable is electrically connected to the terminal.

To ensure reliable electrical connection between the inner conductor and the terminal, in a conventional method, stripping is performed on the coaxial cable to expose the inner conductor, so that the inner conductor is soldered to the terminal. Such a manufacturing process in the method requires soldering, which adds steps to the entire manufacturing process, brings inconvenience to the manufacturing and assembly process, and increases the cost.

In another method, the terminal has a main body portion in the shape of a flat plate. A side of the main body portion is bended and extended upward to form a press-contact portion. The entire terminal is bended and forms a clamp terminal. The inner conductor is disposed on the main body portion, and the insulation cover covers the press-contact portion. When the shield shell presses the insulation cover tightly, the insulation cover presses the press-contact portion, so that the press-contact portion presses the inner conductor against the main body portion, implementing electrical connection between the inner conductor and the terminal. Such a direct press-contact method makes the manufacturing process simple. However, the inner conductor is positioned only through press contact, a gap may exist between the main body portion and the press-contact portion, and the inner conductor may move between the two, affecting the electrical connection performance. In addition, the coaxial cable may be pulled when the cable connector is moved. The external periphery of coaxial cable is clamped by the shield shell, but the cable is not fixed in an extending direction. The coaxial cable may escape along an extending direction thereof from the insulation body and be disconnected from the terminal.

In still another method, a piercing terminal is used. The cable is pressed when being put into the insulation body. A piercing portion of the terminal pierces an inner insulation layer of the cable and contacts the inner conductor. When a pressing force is applied to the cable, the piercing portion needs to pierce the inner insulation layer. If the force is too weak, the piercing portion cannot pierce the inner insulation layer, and the terminal fails to contact the cable. If the force is too strong, the terminal may be damaged.

Therefore, a heretofore unaddressed need exists in the art to address the aforementioned deficiencies and inadequacies.

SUMMARY OF THE INVENTION

In one aspect, the present invention is directed to a cable connector capable of firmly connecting a cable and a terminal, and a manufacturing method thereof.

In one embodiment, a cable connector manufacturing method according to the present invention includes providing an insulation body, putting a terminal that has a receiving portion into the insulation body, preparing at least one groove on a cable, in which the cable has a first part inserted in the insulation body and a second part extending out of the insulation body, and the groove is provided on the first part, pressing the cable, so that a side edge of the receiving portion pierces the cable at the groove, and the terminal is electrically connected to an inner conductor of the cable.

In one embodiment, stripping is performed on the cable before the groove is prepared on the cable, so that an inner insulation layer of the cable is exposed from an outer conductor and an outer insulation layer.

In one embodiment, the cable is flattened to form at least one plane before the groove is prepared.

In one embodiment, a shield shell is provided. The shield shell has a cylindrical portion and a plate portion connected to the cylindrical portion. The insulation body is put into the cylindrical portion. After the aforementioned step is completed, the plate portion is bended, so that the plate portion covers an opening of the cylindrical portion.

In one embodiment, at least one locking piece is disposed on each of two sides of the plate portion. After the aforementioned step is completed, the locking piece is pressed by riveting to wrap the second part.

In another aspect, the present invention is directed to a cable connector manufactured by using the above manufacturing method. The cable connector includes an insulation body that is provided with a receiving slot, a terminal disposed in the insulation body and having a receiving portion, and a cable having a first part and a second part, in which the first part is located in the receiving slot and the second part extends out of the insulation body. At least one groove is provided on the first part, the groove corresponds to the receiving portion, and the terminal is electrically connected to an inner conductor of the cable at the groove.

In one embodiment, the cable is a coaxial cable, and includes the inner conductor, an inner insulation layer, an outer conductor and an outer insulation layer that are disposed from interior or exterior, and the groove is provided on the inner insulation layer.

In one embodiment, the inner insulation layer at the groove is exposed from the outer conductor and the outer insulation layer.

In one embodiment, the cable connector includes a shield shell. The shield shell includes a cylindrical portion and a plate portion connected to the cylindrical portion. The insulation body is received in the cylindrical portion, and the plate portion covers an opening of the cylindrical portion.

In one embodiment, at least one locking piece is disposed at two sides of the plate portion, and the locking piece wraps the cable to fix the cable.

In one embodiment, at least one extending portion is provided on the cylindrical portion along an extending direction of the cable, a dent is provided on the extending portion, and a protruding rib is provided on the locking piece and fits the dent for positioning.

In one embodiment, at least one protruding block is provided on a side of the insulation body, and at least one concave portion is correspondingly provided at an edge of the cylindrical portion. The protruding block is stopped in the concave portion, to prevent the insulation body from falling off from the cylindrical portion.

In one embodiment, the cable connector includes a second groove provided on the first part, the insulation body is provided with a limit portion, and the second groove is buckled with the limit portion, so as to prevent the cable from escaping.

In one embodiment, at least one protruding portion is provided on a side wall of the receiving slot, and the protruding portion stops the cable, so as to prevent the cable from escaping in a direction opposite to an insertion direction thereof.

In one embodiment, the terminal has a base portion. The receiving portion is provided on the base portion, and two clamp portions are provided at two sides of the receiving portion. When the cable is installed, the groove corresponds to the receiving portion, the clamp portions enter the groove, and a gap is provided between the clamp portion and an edge of the groove.

In a further aspect, a cable connector includes an insulation body, in which the insulation body has a limit portion, a terminal disposed in the insulation body and having a receiving portion, and a cable having a first part and a second part, in which the first part is located in the insulation body and the second part extends out of the insulation body. At least two grooves are provided on the cable, at least one of the grooves is correspondingly buckled with the limit portion to maintain the cable in the insulation body, at least one of the grooves is provided corresponding to the receiving portion, and the terminal is electrically connected to the inner conductor of the cable at the groove.

In one embodiment, a receiving slot is prepared on the insulation body along an extending direction of the cable. The first part is located in the receiving slot, at least one protruding portion is provided on a side surface of the receiving slot, and the protruding portion stops the cable, so as to prevent the cable from escaping in a direction opposite to an insertion direction thereof.

In one embodiment, the cable connector includes a shield shell. The shield shell includes a cylindrical portion and a plate portion connected to the cylindrical portion. The insulation body is located in the cylindrical portion, and the plate portion covers an opening of the cylindrical portion.

In one embodiment, at least one locking piece is disposed at two sides of the plate portion, and the locking piece wraps the cable to fix the cable.

In one embodiment, at least one extending portion is provided on the cylindrical portion along an extending direction of the cable, a dent is provided on the extending portion, and a protruding rib is provided on the locking piece and fits the dent for positioning.

Compared with the related art, among other things, the present invention has the following advantages.

A groove is prepared on the cable. When the cable is pressed, a side edge of the receiving portion of the terminal pierces the cable at the groove, and the terminal is electrically connected to the inner conductor of the cable. The groove enables the terminal to pierce the cable easily, implementing desirable electrical connection between the inner conductor and the terminal, and also stops the cable in the extending direction of the cable, preventing the cable from escaping.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
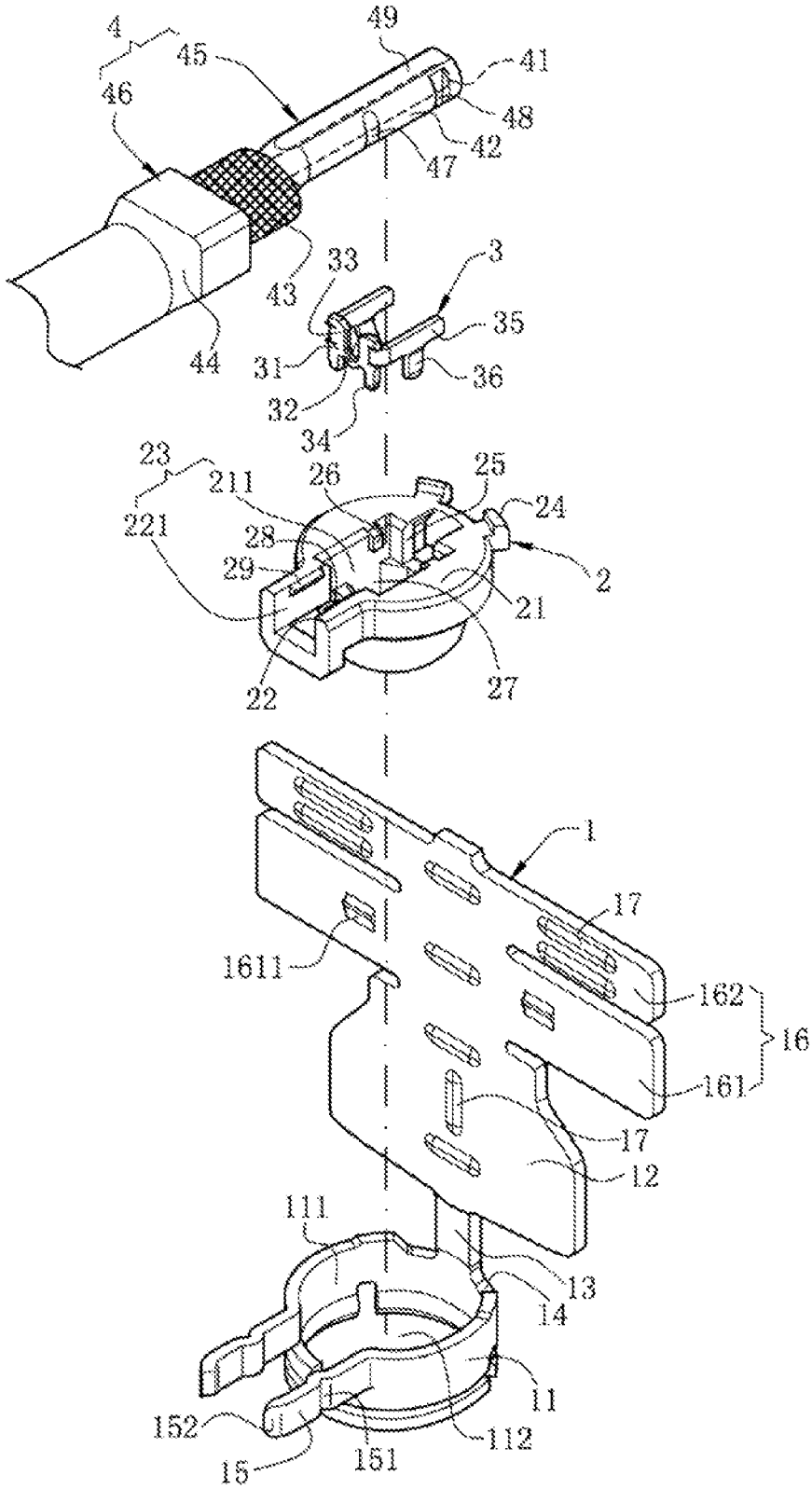
FIG. 1 is a schematic exploded view of a cable connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

As shown in FIG. 1, a cable connector 100 of the present invention includes a shield shell 1, an insulation body 2, a terminal 3, and a cable 4.

As shown in FIG. 1, the shield shell 1 includes a cylindrical portion 11 and a plate portion 12, and a connection portion 13 connects the plate portion 12 and the cylindrical portion 11. The cylindrical portion 11 has a first opening 111 and a second opening 112 that are opposite to each other, and the second opening 112 is below the first opening 111. The plate portion 12 can bend at the connection portion 13, thereby covering the first opening 111. Two concave portions 14 are provided at an edge of the first opening 111, and are respectively located at two sides of the connection portion 13. The cylindrical portion 11 is formed through rolling, and a joint of the roll is at a side opposite to the connection portion 13. The cylindrical portion 11 extends at a side away from the connection portion 13 to form two extending portions 15. A dent 151 is provided on the extending portion 15. A pair of clamp portions 152 is formed at tails of the extending portions 15. Multiple locking pieces 16 are disposed at two sides of the plate portion 12, and include a pair of first locking pieces 161 and a pair of second locking pieces 162. The locking pieces 16 can bend and wrap the cable 4, thereby fixing the cable 4. A protruding rib 1611 corresponding to the dent 151 on the extending portion 15 is provided on the first locking piece 161. When the locking pieces 16 are pressed by riveting, the protruding rib 1611 fits the dent 151 for positioning. Multiple ribs 17 that protrude inward are further provided on the plate portion 12 and the second locking piece 162.

The insulation body 2 is received in the cylindrical portion 11, and has a first main body portion 21 at a front end and a second main body portion 22 at a rear end. A first receiving slot 211 concavely extends downward from a top surface of the first main body portion 21. A second receiving slot 221 concavely extends downward from a top surface of the second main body portion 22. The first receiving slot 211 is in communication with the second receiving slot 221 to form a receiving slot 23 to receive the cable 4. Two protruding blocks 24 are disposed at a front end of the first main body portion 21 and corresponding to the concave portions 14. Two limit portions 25 are provided at a front end of the first receiving slot 211 and close to the protruding blocks 24. Two stop portions 26 are further provided on side walls of the first receiving slot 211 in a protruding manner. A through hole 27 and a fixing slot 28 that are concaved downward are provided at the center of the first receiving slot 211. The fixing slot 28 is near the through hole 27, and the stop portions 26 are located above the through hole 27. Two protruding portions 29 that protrude toward the interior of the second receiving slot 221 are provided on side walls of the second receiving slot 221. The protruding portion 29 is wedge-shaped.

The terminal 3 has a vertical base portion 31 that shapes like a plate. A receiving portion 32 is provided at the center of the base portion 31. The receiving portion 32 is U-shaped. Two clamp portions 33 are formed at two sides of the receiving portion 32, and two fixing portions 34 extend downward from the clamp portions 33. The fixing portions 34 are fixed in the fixing slot 28. The base portion 31 bends laterally to form two elastic arms 35 through extending. Two contact portions 36 are extended from middle portions of the elastic arms 35. The contact portions 36 enter the through hole 27. The elastic arms 35 are stopped by the stop portions 26, preventing the terminal 3 from escaping.

Figure 5:
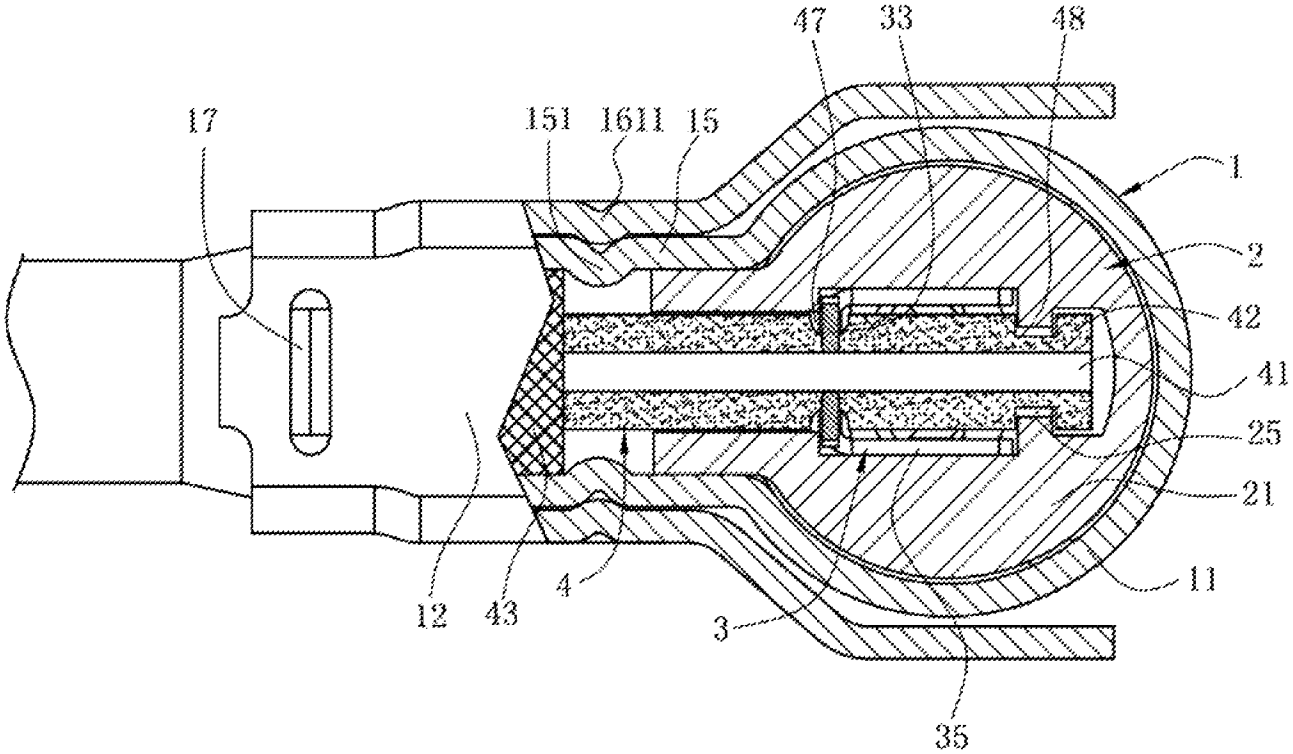
FIG. 5 is a cutaway top view of a part of a cable connector according to one embodiment of the present invention.

As shown in FIGS. 1 and 5, the cable 4 is a coaxial cable and includes an inner conductor 41, an inner insulation layer 42, an outer conductor 43, and an outer insulation layer 44 that are disposed from interior to exterior. The cable 4 has a first part 45 and a second part 46. The first part 45 is located in the insulation body 2, and the second part 46 extends out of the insulation body 2. The first part 45 only has the inner insulation layer 42 and the inner conductor 41. A pair of first grooves 47 is provided on the inner insulation layer 42. The first grooves 47 are provided corresponding to the receiving portion 32 of the terminal 3. When the cable 4 enters the receiving portion 32, the clamp portions 33 enter the first grooves 47, pierce the inner insulation layer 42 at the grooves and contact the inner conductor 41. A gap is provided between the clamp portion 33 and an edge of the first groove 47, so that the clamp portion 33 enters the first groove 47 easily. A pair of second grooves 48 is further provided at a front end of the inner insulation layer 42. The second grooves 48 are provided corresponding to the limit portions 25 of the insulation body 2. When the cable 4 is put into the insulation body 2, the second grooves 48 are buckled with the limit portions 25 to prevent the cable 4 from escaping along an extending direction thereof. The cable 4 has two opposite planes 49. During preparation of the first grooves 47 and the second grooves 48, the planes 49 have a positioning function. The first grooves 47 and the second grooves 48 are provided on cambered surfaces at side edges of the planes 49. The first grooves 47 and the second grooves 48 are only provided on the inner insulation layer 42, and do not completely penetrate the inner insulation layer 42, so that the remaining inner insulation layer 42 protects the inner conductor 41.

A manufacturing method of the cable connector 100 is as follows:

As shown in FIG. 1, at an initial state, the shield shell 1 is a metal plate. The cylindrical portion 11 is first formed by rolling. The plate portion 12 is connected to the cylindrical portion 11 and is in an open state. The plate portion 12 has an inclined angle relative to the cylindrical portion 11. The locking pieces 16 at two sides of the plate portion 12 are flat.

Figure 2:
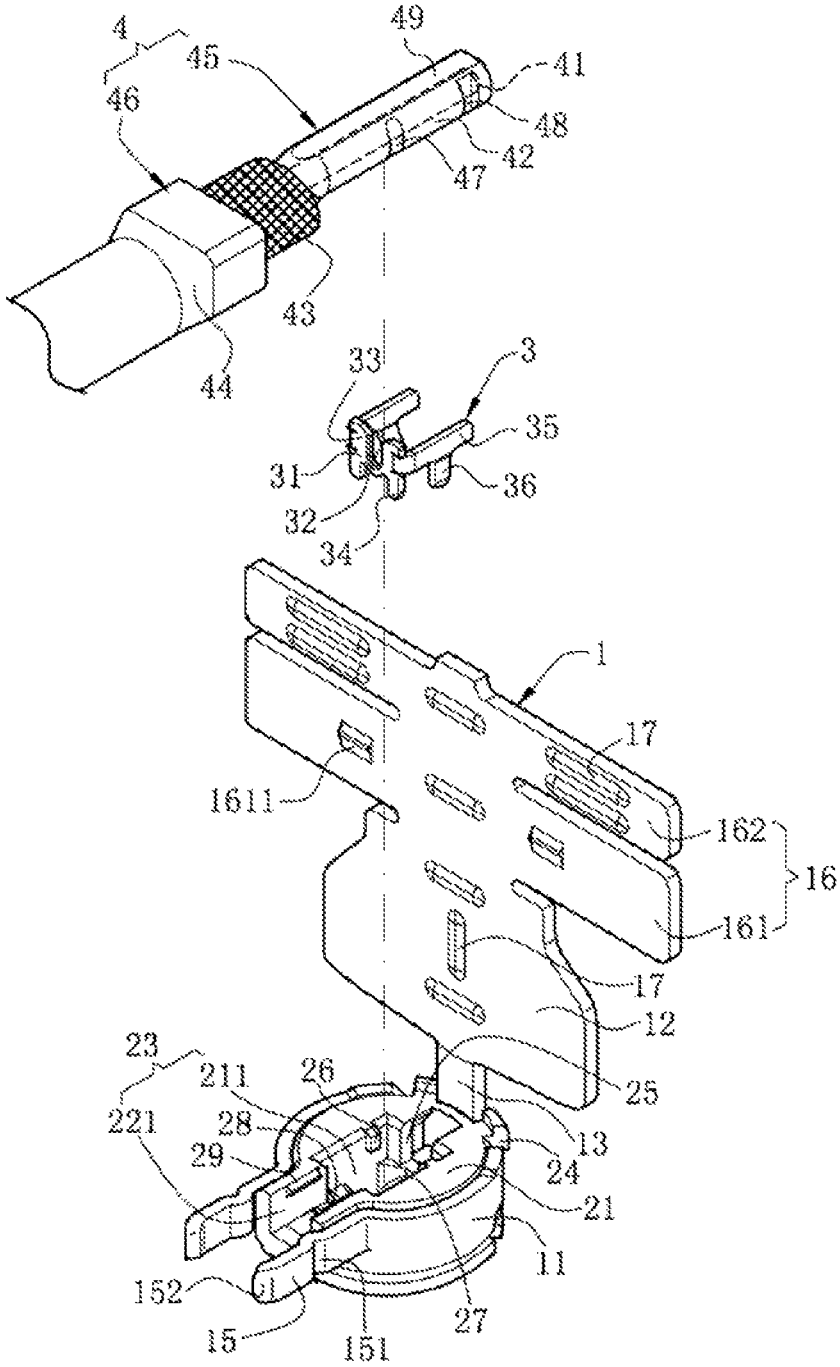
FIG. 2 is a schematic exploded view of an insulation body of a cable connector put into a cylindrical portion according to one embodiment of the present invention.

As shown in FIG. 2, the insulation body 2 is put downward into the cylindrical portion 11. The two protruding blocks 24 at the front end are clamped in the two concave portions 14. The second main body portion 22 is stopped at the edge of the first opening 111. The three portions are used to stop the insulation body 2, so as to prevent the insulation body 2 from falling off from the cylindrical portion 11. The second main body portion 22 is clamped between the two extending portions 15.

Figure 3:
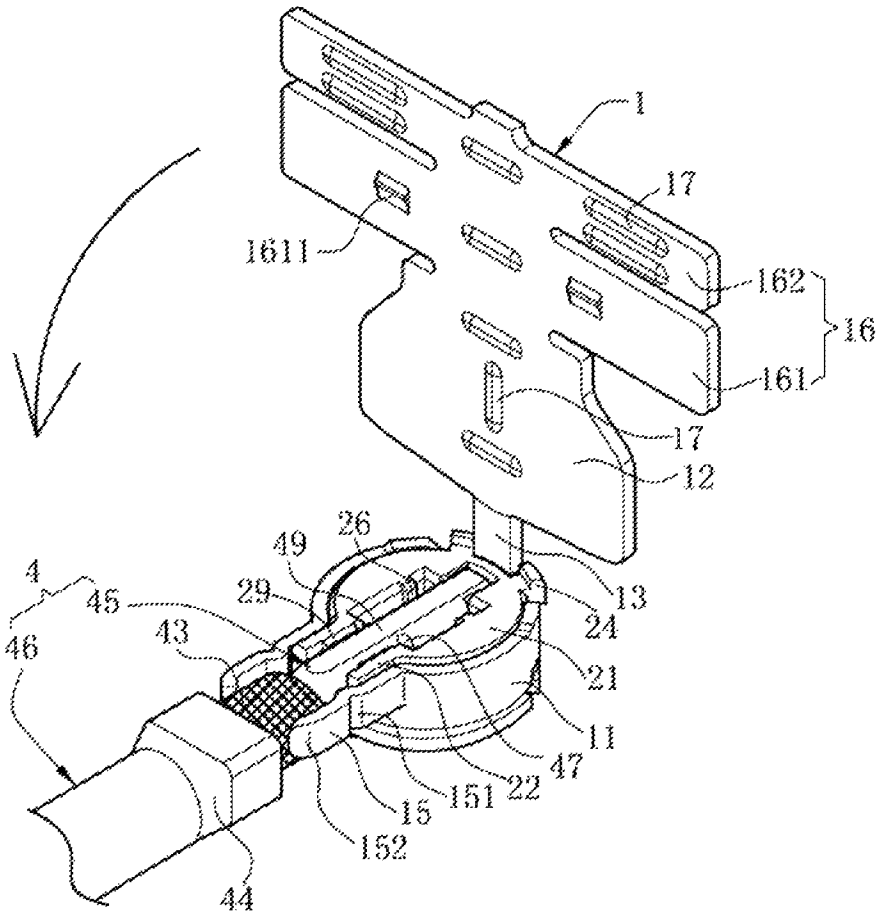
FIG. 3 is a schematic three-dimensional view of a cable connector before a cover body thereof is bended according to one embodiment of the present invention.

As shown in FIGS. 1-3, the terminal 3 is put downward into the insulation body 2. The contact portions 36 enter the through hole 27. The fixing portion 34 is clamped in the fixing slot 28. The elastic arms 35 cross the stop portions 26 and are stopped by the stop portions 26, so that the terminal 3 does not escape in a direction opposite to the insertion direction thereof.

The cable is flattened to form the two opposite planes 49. In subsequent operations, the planes 49 are used to position the cable 4.

An automatic wire-stripping machine may be used to perform stripping on the cable 4, so that only the inner insulation layer 42 and the inner conductor 41 remain at the first part 45 of the cable 4, and the inner insulation layer 42 completely wraps the inner conductor 41. The outer insulation layer 44, close to the first part 45, of the second part 46 is stripped off to expose the outer conductor 43.

As shown in FIG. 1, the first grooves 47 and the second grooves 48 are prepared on the inner insulation layer 42 of the first part 45. The first grooves 47 and the second grooves 48 are prepared on the cambered surfaces of the side edges of the two planes 49. The width of the first groove 47 is greater than the thickness of the base portion 31 of the terminal 3. The first grooves 47 and the second grooves 48 are only provided on the inner insulation layer 42, and do not completely penetrate the inner insulation layer 42, so that the remaining inner insulation layer 42 protects the inner conductor 41, avoiding damage to the inner conductor 41 during manufacturing.

As shown in FIGS. 3 and 5, the cable 4 is pressed downward to be connected, so that the first grooves 47 are corresponding to the receiving portion 32. The cable 4 crosses the protruding portions 29 and is stopped below the protruding portions 29. The first part 45 enters the receiving slot 23. The first grooves 47 are clamped in the receiving portion 32. The two clamp portions 33 enter the first grooves 47, pierce the inner insulation layer 42 on the side walls of the first grooves 47, and contact the inner conductor 41. A gap is provided between the clamp portion 33 and the edge of the first groove 47, so that the clamp portion 33 enters the first groove 47 easily. The inner insulation layer 42 at the first groove 47 is thin, so a user can make the clamp portion 33 pierce the inner insulation layer 42 and be electrically connected to the inner conductor 41 with a small force. The terminal 3 is prevented from being damaged by an excessive force. The second grooves 48 enter the limit portions 25 in a clamped manner, and are buckled with the limit portions 25, thereby limiting the movement of the cable 4 in the extending direction thereof. When the cable 4 is pulled, the second grooves 48 are buckled at the limit portions 25, so that the cable 4 does not escape backward. The limit portions 25 stop the cable 4 in a vertical direction, preventing the cable 4 from escaping in a direction opposite to the insertion direction thereof. Meanwhile, the clamp portions 152 at the tail ends of the extending portions 15 clamp the outer conductor 43 of the second part 46, thereby fixing the cable 4 to a degree.

Figure 4:
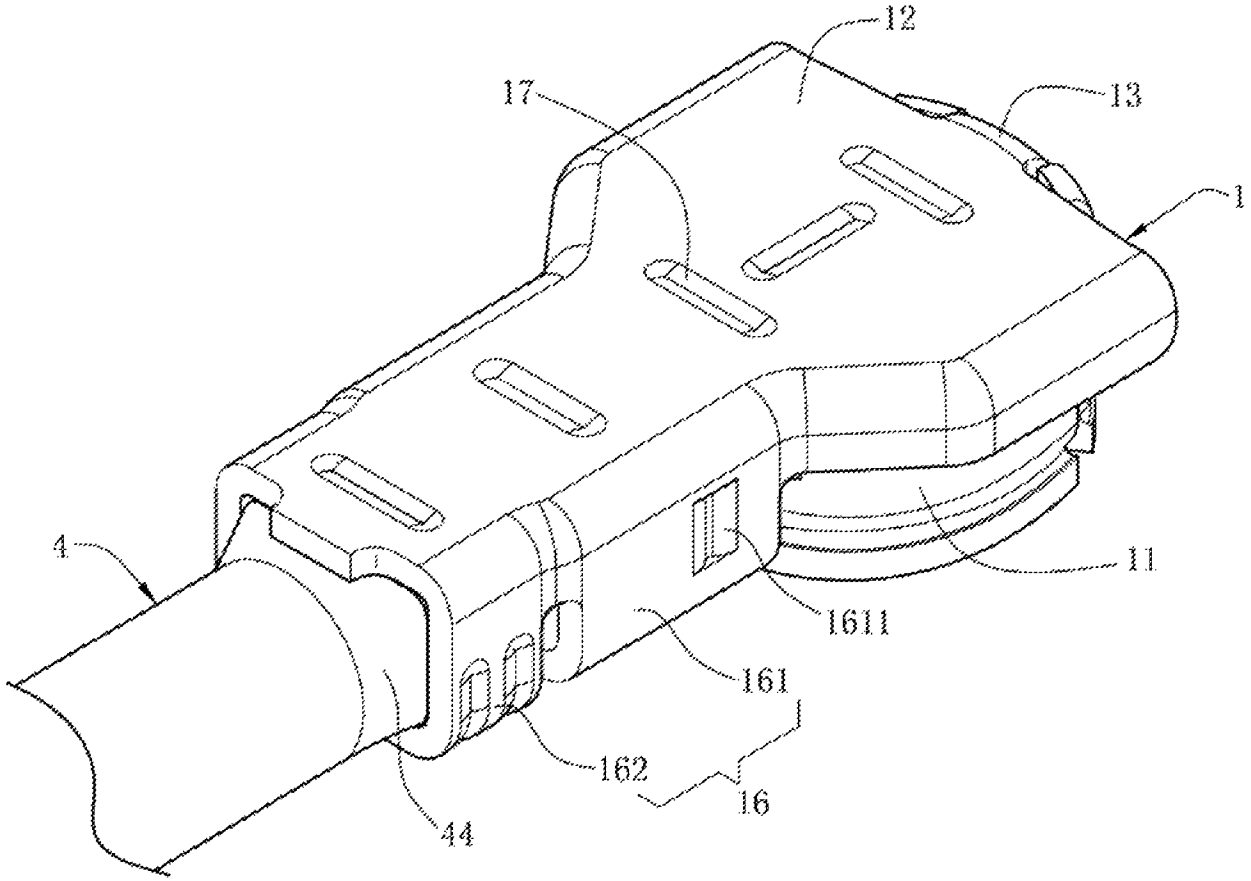
FIG. 4 is a schematic three-dimensional assembly view of a cable connector according to one embodiment the present invention.

As shown in FIGS. 3 and 4, after the cable 4 is installed, the plate portion 12 is bended. The plate portion 12 covers the first opening 111, the insulation body 2, and an upper surface of the cable 4, so that the insulation body 2 and the cable 4 do not escape from the cylindrical portion 11 in a direction opposite to the insertion direction thereof. The ribs 17 on the plate portion 12 press the cable 4, enhancing retention of the cable 4 and the shield shell 1.

Figure 6:
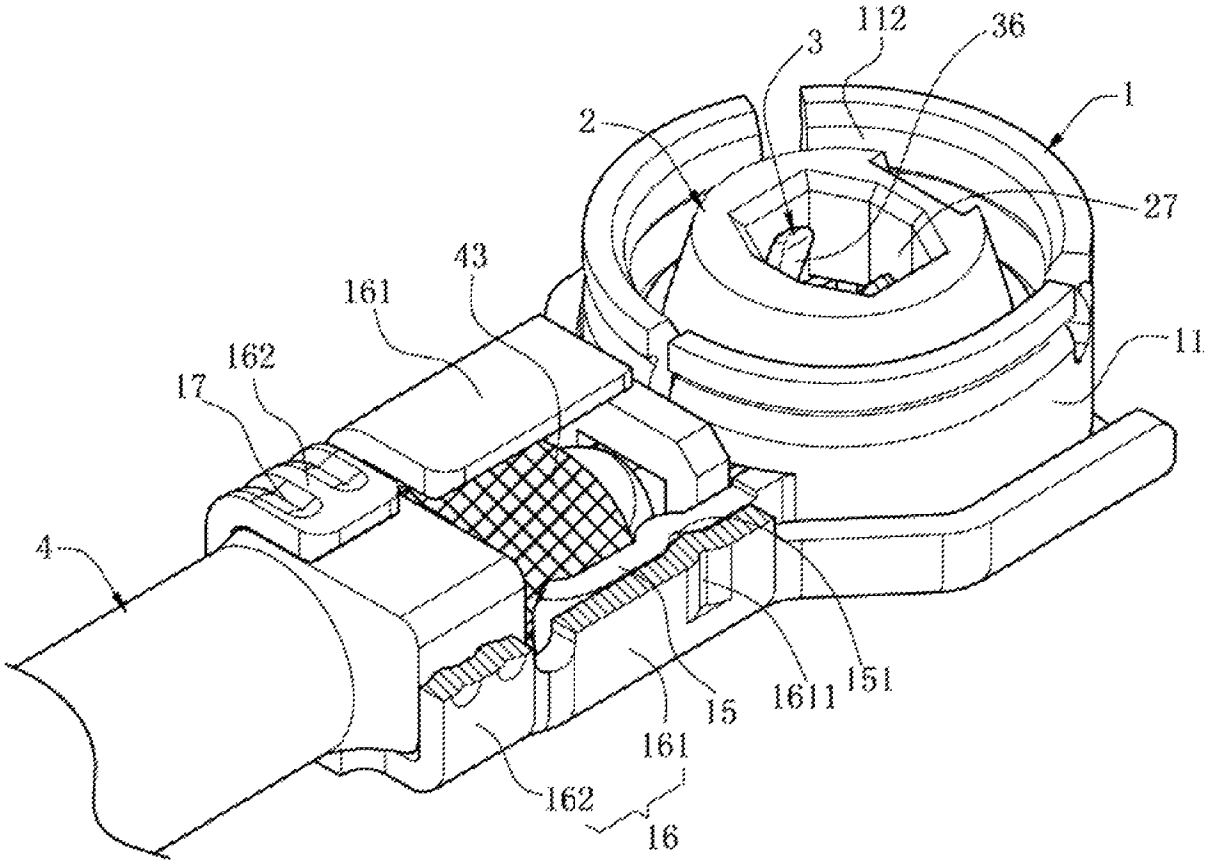
FIG. 6 is a three-dimensional cutaway view of a part of a cable connector according to one embodiment of the present invention.

As shown in FIG. 6, finally, the locking pieces 16 are pressed by riveting, so that the locking pieces 16 are bended and wrap the cable 4. The protruding rib 1611 on the first locking piece 161 is buckled with the dent 151 on the extending portion 15, enhancing retention of the locking piece 16 and the extending portion 15. The first locking piece 161 wraps a surface of the outer conductor 43, and the second locking piece 162 wraps a surface of the outer insulation layer 44, thereby fixing the cable 4. Meanwhile, the ribs 17 on the locking pieces 16 urge against an outer surface of the cable 4, so that the cable 4 and the locking pieces 16 are better fixed.

In conclusion, the cable connector 100 of the present invention, among other things, has the following advantages.

(1) The first groove 47 is prepared on the first part 45. When the cable 4 is inserted into the insulation body 2, the clamp portion 33 of the terminal 3 enters the first groove 47, and pierces the inner insulation layer 42 at the first groove 47, so as to be electrically connected to the inner conductor 41 of the cable 4. The inner insulation layer 42 at the first groove 47 is thin, so a user can make the clamp portion 33 pierce the inner insulation layer 42 and be electrically connected to the inner conductor 41 with a small force. The terminal 3 is prevented from being damaged by an excessive force.

(2) The second groove 48 is prepared on the cable 4. When the cable 4 is inserted into the insulation body 2, the second groove 48 enters the limit portion 25 in a clamped manner, and is buckled with the limit portion 25, limiting the movement of the cable 4 in the extending direction thereof. When the cable 4 is pulled, the second groove 48 is buckled at the limit portion 25, so that the cable 4 does not escape backward.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable connector manufacturing method, comprising:

providing an insulation body;

putting a terminal into the insulation body, wherein the terminal has a receiving portion;

preparing at least one groove on a cable, wherein the cable has a first part inserted into the insulation body and a second part extending out of the insulation body, and the groove is provided on the first part; and pressing the cable, so that a side edge of the receiving portion pierces the cable at the groove, and the terminal is electrically connected to an inner conductor of the cable.

2. The method according to claim 1, wherein stripping is performed on the cable before the groove is prepared on the cable, so that an inner insulation layer of the cable is exposed from an outer conductor and an outer insulation layer.

3. The method according to claim 1, wherein the cable is flattened to form at least one plane before the groove is prepared.

4. The method according to claim 1, further comprising:

providing a shield shell, wherein the shield shell has a cylindrical portion and a plate portion connected to the cylindrical portion, the insulation body is put into the cylindrical portion, and after the aforementioned step is completed, the plate portion is bended, so that the plate portion covers an opening of the cylindrical portion.

5. The method according to claim 4, wherein at least one locking piece is disposed at each of two sides of the plate portion, and after the aforementioned step is completed, the locking piece is pressed by riveting, so that the locking piece wraps the second part.

6. A cable connector manufactured through the manufacturing method according to claim 1, comprising:

an insulation body, provided with a receiving slot;

a terminal, disposed in the insulation body and having a receiving portion;

a cable, having a first part and a second part, wherein the first part is located in the receiving slot and the second part extends out of the insulation body, at least one first groove is provided on the first part, the first groove is provided corresponding to the receiving portion, and the terminal is electrically connected to an inner conductor of the cable at the first groove.

7. The cable connector according to claim 6, wherein the cable is a coaxial cable and comprises the inner conductor, an inner insulation layer, an outer conductor, and an outer insulation layer that are disposed from interior or exterior, and the first groove is provided on the inner insulation layer.

8. The cable connector according to claim 7, wherein the inner insulation layer at the first groove is exposed from the outer conductor and the outer insulation layer.

9. The cable connector according to claim 6, further comprising a shield shell, wherein the shield shell comprises a cylindrical portion and a plate portion connected to the cylindrical portion, the insulation body is received in the cylindrical portion, and the plate portion covers an opening of the cylindrical portion.

10. The cable connector according to claim 9, wherein at least one locking piece is disposed at two sides of the plate portion, and the locking piece wraps the cable to fix the cable.

11. The cable connector according to claim 10, wherein at least one extending portion is provided on the cylindrical portion along an extending direction of the cable, a dent is provided on the extending portion, and a protruding rib is provided on the locking piece and fits the dent for positioning.

12. The cable connector according to claim 9, wherein at least one protruding block is provided on a side of the insulation body, at least one concave portion is correspondingly provided at an edge of the cylindrical portion, and the block is stopped in the concave portion, to prevent the insulation body from falling off from the cylindrical portion.

13. The cable connector according to claim 6, further comprising a second groove provided on the first part, the insulation body is provided with a limit portion, and the second groove is buckled with the limit portion, so as to prevent the cable from escaping.

14. The cable connector according to claim 6, wherein at least one protruding portion is provided on a side wall of the receiving slot, and the protruding portion stops the cable, so as to prevent the cable from escaping in a direction opposite to an insertion direction thereof.

15. The cable connector according to claim 6, wherein the terminal has a base portion, the receiving portion is provided on the base portion, and two clamp portions are provided at two sides of the receiving portion; and wherein when the cable is installed, the first groove corresponds to the receiving portion, the clamp portions enter the first groove, and a gap is provided between the clamp portion and an edge of the first groove.

16. A cable connector, comprising:

an insulation body, having a limit portion;

a terminal, disposed in the insulation body, wherein the terminal has a receiving portion;

a cable, having a first part and a second part, wherein the first part is located in the receiving slot and the second part extends out of the insulation body, at least two grooves are provided on the cable, at least one of the grooves is correspondingly buckled with the limit portion to maintain the cable in the insulation body, at least one of the grooves is disposed corresponding to the receiving portion, and the terminal is electrically connected to the inner conductor of the cable at the groove corresponding to the receiving portion.

17. The cable connector according to claim 16, wherein the cable is a coaxial cable and comprises the inner conductor, an inner insulation layer, an outer conductor, and an outer insulation layer that are disposed from interior or exterior, the grooves are provided on the inner insulation layer, the inner insulation layer at the grooves are exposed from the outer conductor and the outer insulation layer.

18. The cable connector according to claim 16, wherein a receiving slot is prepared on the insulation body along an extending direction of the cable, the first part is located in the receiving slot, at least one protruding portion is provided on a side surface of the receiving slot, and the protruding portion stops the cable, so as to prevent the cable from escaping in a direction opposite to an insertion direction thereof.

19. The cable connector according to claim 16, further comprising a shield shell, wherein the shield shell comprises a cylindrical portion and a plate portion connected to the cylindrical portion, the insulation body is located in the cylindrical portion, and the plate portion covers an opening of the cylindrical portion.

20. The cable connector according to claim 19, wherein at least one locking piece is disposed at two sides of the plate portion, and the locking piece wraps the cable to fix the cable.

21. The cable connector according to claim 20, wherein at least one extending portion is provided on the cylindrical portion along an extending direction of the cable, a dent is provided on the extending portion, and a protruding rib is provided on the locking piece and fits the dent for positioning.

* * * * *